US012376719B2

(12) United States Patent
Lee et al.

(10) Patent No.: US 12,376,719 B2
(45) Date of Patent: Aug. 5, 2025

(54) VACUUM CLEANER

(71) Applicant: LG ELECTRONICS INC., Seoul (KR)

(72) Inventors: Jong Myung Lee, Seoul (KR); Chi Wan Kim, Seoul (KR); Jin Rae Cho, Seoul (KR); Jung Woo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 258 days.

(21) Appl. No.: 17/777,462

(22) PCT Filed: Dec. 1, 2020

(86) PCT No.: PCT/KR2020/017380
§ 371 (c)(1),
(2) Date: May 17, 2022

(87) PCT Pub. No.: WO2021/112528
PCT Pub. Date: Jun. 10, 2021

(65) Prior Publication Data

US 2023/0355054 A1 Nov. 9, 2023

(30) Foreign Application Priority Data

Dec. 3, 2019 (KR) ..... 10-2019-0159187

(51) Int. Cl.
*A47L 9/04* (2006.01)
*A46B 9/02* (2006.01)
(Continued)

(52) U.S. Cl.
CPC ..... *A47L 9/0477* (2013.01); *A46B 9/026* (2013.01); *A46B 13/006* (2013.01); *A46B 13/02* (2013.01);
(Continued)

(58) Field of Classification Search
None
See application file for complete search history.

(56) References Cited

U.S. PATENT DOCUMENTS 6,125,495 A 10/2000 Berg et al.
2002/0129462 A1 9/2002 Matusz et al.
(Continued)

FOREIGN PATENT DOCUMENTS

CN 109715022 A 5/2019
DE 202018101345 U1 4/2018
(Continued)

OTHER PUBLICATIONS

Office Action in Chinese Appln. No. 202080082496.5, mailed on Aug. 24, 2023, 18 pages (with English translation).
(Continued)

*Primary Examiner* — Brian D Keller
*Assistant Examiner* — Jason Khalil Hawkins
(74) *Attorney, Agent, or Firm* — Fish & Richardson P.C.

(57) ABSTRACT

A vacuum cleaner according to the present disclosure includes a main body and a suction nozzle. The suction nozzle includes a housing and a rotating brush. The rotating brush includes a first rotating brush, a second rotating brush, and a coupler. The coupler couples the first rotating brush and the second rotating brush so that a rotation axis of the first rotating brush and a rotation axis of the second rotating brush are positioned on the same line.

19 Claims, 15 Drawing Sheets

(51) Int. Cl.

| | |
|---|---|
| ***A46B 13/00*** | (2006.01) |
| ***A46B 13/02*** | (2006.01) |
| ***A47L 5/30*** | (2006.01) |

(52) U.S. Cl.

CPC ..... *A47L 5/30* (2013.01); *A47L 9/0411* (2013.01); *A46B 2200/3033* (2013.01)

(56) References Cited

U.S. PATENT DOCUMENTS

| | | | | |
|---|---|---|---|---|
| 2017/0143175 | A1 | 5/2017 | Kim et al. | |
| 2018/0271341 | A1 | 9/2018 | Hu et al. | |
| 2020/0046183 | A1* | 2/2020 | Choi | A47L 9/0477 |
| 2022/0053984 | A1* | 2/2022 | Karlsson | A47L 11/4041 |

FOREIGN PATENT DOCUMENTS

| | | | |
|---|---|---|---|
| GB | 464048 | A | 4/1937 |
| JP | H07322 | | 1/1995 |
| JP | H07322 | A | 1/1995 |
| KR | 20040050472 | | 6/2004 |
| KR | 20040050472 | A | 4/2005 |
| KR | 20170058575 | | 5/2017 |
| KR | 20190080855 | | 7/2019 |
| KR | 10-2020-0017723 | A | 2/2020 |
| KR | 20170058575 | A | 4/2022 |
| WO | WO2019196265 | A1 | 10/2019 |

OTHER PUBLICATIONS

Extended Search Report in European Appln. No. 20895231.7, mailed on Feb. 27, 2023, 7 pages.

Office Action in Chinese AppIn. No. 202080082496.5, mailed on Mar. 3, 2023, 20 pages (with English translation).

Office Action in Korean Appln. No. 10-2019-0159187, mailed on Jul. 10, 2024, 11 pages (with English translation).

* cited by examiner

VACUUM CLEANER

CROSS-REFERENCE TO RELATED APPLICATIONS

This application is a National Phase Application under 35 U.S.C. § 371 of International Application No. PCT/KR2020/017380, filed on Dec. 1, 2020, which claims priority to Korean Application No. 10-2019-0159187, filed on Dec. 3, 2019. The disclosures of the prior applications are incorporated by reference in their entirety.

FIELD

The present disclosure relates to a vacuum cleaner, and more particularly, to a vacuum cleaner capable of clearly cleaning a smooth floor by removing dust with a rotating brush.

BACKGROUND

A cleaning ability of a vacuum cleaner varies depending on the types of brushes mounted on the vacuum cleaner.

A carpet brush made of stiff plastic is advantageous for efficiency in cleaning an uneven carpet. Meanwhile, a floor brush made of soft flannel is advantageous for efficiency in cleaning a smooth floor or papered floor.

The floor brush made of flannel is used to avoid scratches on the floor that may be caused by the stiff brush. In addition, when the brush made of flannel rotates at a high speed, the brush may lift up fine dust attached to the floor and then suck and remove the fine dust.

In this regard, Korean Patent Application Laid-Open No. 2019-0080855 (hereinafter, referred to as 'Patent Document 1') discloses a vacuum cleaner. The vacuum cleaner disclosed in Patent Document 1 includes a cleaner main body and a suction nozzle. The suction nozzle includes a housing, a rotary cleaning unit, a driver, and a rotation support unit.

The rotary cleaning unit includes a nozzle body, a fiber layer, fiber bristles, and metal bristles. The fiber layer surrounds an outer peripheral surface of the nozzle body. The fiber bristles and the metal bristles are implanted into the fiber layer.

A portion in which the fiber bristles and the metal bristles are implanted may be divided into a strap portion and an antistatic portion. The strap portion includes the fiber bristles. The metal bristles are not implanted in the strap portion. The antistatic portion includes the fiber bristles and the metal bristles. The antistatic portion is disposed between the strap portions.

The implanted fiber and metal bristles form textures in one direction on the fiber layer. That is, the implanted fiber and metal bristles are implanted inclinedly in one direction. The implanted fiber and metal bristles form the textures in a longitudinal direction of the strap portion (or the antistatic portion).

The strap portion and the antistatic portion may extend in a longitudinal direction of the nozzle body. In addition, the strap portion and the antistatic portion may extend in a circumferential direction of the nozzle body. In addition, the strap portion and the antistatic portion extend in a spiral direction of the nozzle body.

The rotary cleaning unit is configured to move dust rearward by scraping a floor surface with a plurality of bristles. Debris such as hairs and dust may be easily attached between the bristles of the rotary cleaning unit.

However, in the case in which the strap portion and the antistatic portion extend in the spiral direction of the nozzle body, there is a problem in that debris such as hairs and dust is trapped at an end of the rotary cleaning unit.

The plurality of bristles is repeatedly folded and unfolded while periodically coming into contact with the floor during the process of rotating the rotary cleaning unit. In this process, debris such as hairs and dust moves in one direction of the rotary cleaning unit.

The rotation support unit and the driver are disposed at the end of the rotary cleaning unit. The debris such as hairs and dust, which is moved to the end of the rotary cleaning unit, is trapped between the rotation support unit and the body or between the rotation support unit and a side cover. Therefore, the rotation of the rotary cleaning unit gradually becomes difficult.

Meanwhile, in the case in which the strap portion and the antistatic portion extend in the longitudinal direction of the nozzle body, there is a problem in that debris such as hairs and dust is concentrated in a particular region of the rotary cleaning unit. The particular region may mean a middle portion of the rotary cleaning unit. The particular region may mean the end of the rotary cleaning unit.

A process of manufacturing the rotary cleaning unit is as follows. First, the fiber bristles and the metal bristles are implanted into the fiber layer. Next, the fiber layer is attached to an outer surface of the body. The applicant of the present disclosure has attempted to attach the plurality of fiber layers, in which the bristles are implanted with different textures, to the outer surface of the body to solve the above-mentioned problems.

However, it is not easy to accurately attach the plurality of fiber layers for each particular region on the outer surface of the body. If the fiber layers are not accurately attached to the particular region on the outer surface of the body, there occur portions in which the fiber layers are spaced apart from one another or the fiber layers overlap one another.

SUMMARY

An aspect of the present disclosure is to provide a vacuum cleaner in which debris such as hairs and dust attached to a rotating brush is prevented from being moved to and trapped at an end of the rotating brush or concentrated in a particular portion.

Another aspect of the present disclosure is to provide a vacuum cleaner in which brush members are provided on an outer surface of a rotating brush without being spaced apart from one another or overlapping one another.

Still another aspect of the present disclosure is to provide a vacuum cleaner in which a rotating brush may be quickly manufactured even though brush members having different textures are attached to an outer surface of the body.

In a vacuum cleaner according to an embodiment of the present disclosure, a coupler couples a first rotating brush and a second rotating brush so that a rotation axis of the first rotating brush and a rotation axis of the second rotating brush are positioned on the same line. Therefore, the rotating brush may be quickly manufactured even though brush members having different textures are attached to an outer surface of a body.

The vacuum cleaner according to the embodiment of the present disclosure may include a main body and a suction nozzle.

The main body may generate a difference in air pressure. An air blower may be provided in the main body.

The suction nozzle may suck dust on the floor by using the difference in air pressure.

The suction nozzle may include a housing and a rotating brush.

The housing may have an inlet through which dust moves to the main body.

A driver may be installed in the housing.

The rotating brush may rotate to push dust on the floor toward the inlet.

The rotating brush may include the first rotating brush, the second rotating brush, and the coupler.

The driver may transmit a rotational motion to the first rotating brush.

The driver may include a motor and a transmission.

The motor may generate a rotational force. The motor may be provided as a BLDC motor. The transmission may transmit the rotational motion of the motor to the first rotating brush.

The second rotating brush may be rotatably mounted in the housing.

Meanwhile, the first rotating brush may include a first body having a cylindrical shape, and a first brush member.

The first body may have a first through-hole formed in a radial direction.

The first brush member may be attached to an outer surface of the first body.

The second rotating brush may include a second body having a cylindrical shape, and a second brush member.

The second body may have a second through-hole formed in the radial direction.

The second brush member may be attached to an outer surface of the second body.

The first and second brush members may each have a plurality of bristles. The bristles may push the dust toward the inlet while being elastically bent and deformed by the floor.

An outer surface of the coupler body may come into contact with an inner surface of the second body in a circumferential direction.

The coupler may include a coupler body, a first catching portion, a first bending deformation portion, a second catching portion, and a second bending deformation portion.

The outer surface of the coupler body may come into contact with the inner surface of the first body in the circumferential direction.

The first catching portion may be inserted into the first through-hole.

The first bending deformation portion may connect the coupler body and the first catching portion.

The first bending deformation portion may be bent and deformed in the radial direction of the coupler body.

The second catching portion may be inserted into the second through-hole.

The second bending deformation portion may connect the coupler body and the second catching portion.

The second bending deformation portion may be bent and deformed in the radial direction of the coupler body.

The protruding portion may be formed on an inner surface of the first body in the direction of the rotation axis of the rotating brush. The insertion groove may be formed in the outer surface of the coupler body in the direction of the rotation axis of the rotating brush.

The protruding portion may move along the insertion groove until the first catching portion is inserted into the first through-hole.

The protruding portion and the insertion groove may guide the first catching portion to the first through-hole. The protruding portion and the insertion groove may prevent a relative rotation between the coupler body and the first body.

The protruding portion may be formed on an inner surface of the second body in the direction of the rotation axis of the rotating brush. The insertion groove may be formed in the outer surface of the coupler body in the direction of the rotation axis of the rotating brush.

The protruding portion may move along the insertion groove until the second catching portion is inserted into the second through-hole.

The protruding portion and the insertion groove may guide the second catching portion to the second through-hole. The protruding portion and the insertion groove may prevent a relative rotation between the coupler body and the second body.

When the first catching portion is inserted into the first through-hole, the relative movement and rotation between the coupler body and the first body may be prevented. When the second catching portion is inserted into the second through-hole, the relative movement and rotation between the coupler body and the second body may be prevented. When the second catching portion is inserted into the second through-hole, the first and second bodies come into contact with each other in the direction of the rotation axis of the rotating brush, thereby defining a contact surface. Therefore, the first and second brush members may be provided on the outer surface of the rotating brush without being spaced apart from each other or overlapping each other.

A bonding layer may be interposed between the inner surface of the first body, the inner surface of the second body, and the outer surface of the coupler body. The bonding layer may improve a coupling force between the first body and the coupler body and between the second body and the coupler body.

The textures of the bristles may be spirally formed around the rotation axis.

The textures of the bristles may be formed symmetrically with respect to the contact surface.

The textures of the bristles may be inclined toward the contact surface. Further, the textures of the bristles may be inclined in the direction opposite to the rotation direction of the rotating brush.

As the bristles of the first and second rotating brushes are moved away from the floor, the bristles are elastically restored and returned to an original state. In this case, the debris, which is in contact with the bristles, is pushed toward the contact surface and the inlet by kinetic energy and elastic restoring force of the bristles.

Therefore, the debris such as hairs and dust attached to the rotating brush is prevented from being moved to and trapped at the end of the rotating brush or concentrated in a particular portion.

According to the embodiment of the present disclosure, the coupler couples the first and second rotating brushes so that the rotation axes of the first and second rotating brushes are positioned on the same line. Therefore, the rotating brush, in which the textures of the bristles are symmetric with respect to the contact surface between the first and second rotating brushes, may be quickly manufactured by attaching the brush members to the outer surfaces of the separated bodies and then coupling the separated bodies by using the coupler.

According to the embodiment of the present disclosure, the first brush member is attached to the outer surface of the first body, the second brush member is attached to the outer surface of the second body, and the first and second bodies are coupled to be in contact with each other in the direction of the rotation axis. Therefore, the first and second brush members may be tightly in close contact with each other without a gap on the same plane as the contact surface between the first and second rotating brushes.

According to the embodiment of the present disclosure, the textures of the bristles are spirally formed around the rotation axis, symmetrically formed with respect to the contact surface, and inclined toward the contact surface in the direction opposite to the rotation direction of the rotating brush. Therefore, the debris such as hairs and dust attached to the rotating brush may be moved to the front side of the inlet and sucked into the inlet or conveniently removed by the user.

BRIEF DESCRIPTION OF THE DRAWINGS

The above and other aspects, features, and advantages of the present disclosure will become apparent from the detailed description of the following aspects in conjunction with the accompanying drawings.

DESCRIPTION OF SYMBOLS

Figure 1:
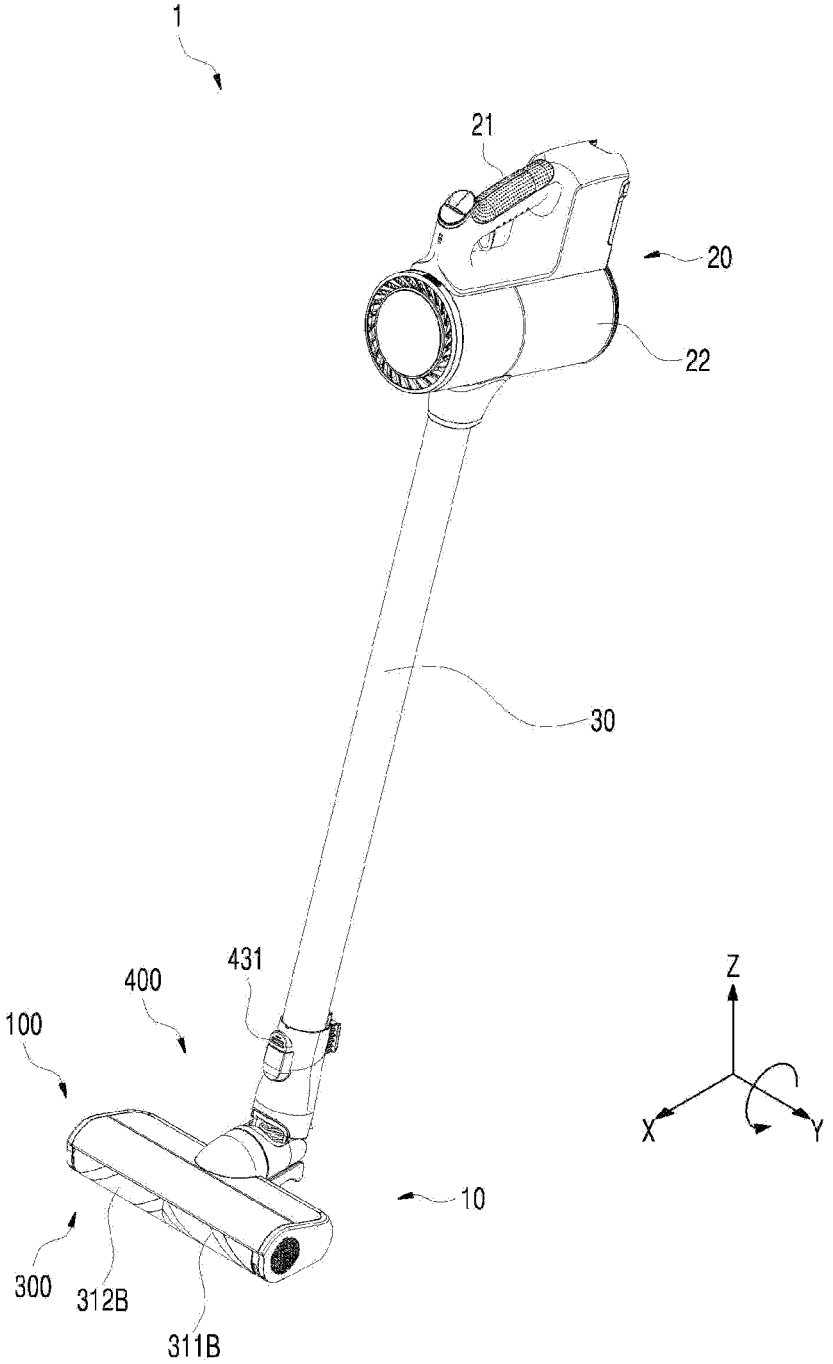
FIG. 1 is a perspective view illustrating a vacuum cleaner according to an embodiment of the present disclosure.

1: VACUUM CLEANER
20: MAIN BODY
21: HANDLE
22: DUST BOX
30: EXTENSION PIPE
10: SUCTION NOZZLE
100: HOUSING
101: SUCTION SPACE
110: MAIN HOUSING
111: INLET
120: LOWER HOUSING
121: FIRST LOWER HOUSING
122: SECOND LOWER HOUSING
130: MOUNTING HOUSING
131: COVER PORTION
140: SUPPORT HOUSING
141: PRESSING BUTTON
150: SIDE SURFACE COVER
W1: FIRST WHEEL
W2: SECOND WHEEL
200: DRIVER
210: BRACKET
220: MOTOR
230: TRANSMISSION
231: FIRST BELT TRANSMISSION
300: BRUSH MODULE
310: ROTATING BRUSH
311: FIRST ROTATING BRUSH
311A: FIRST BODY
311H: FIRST THROUGH-HOLE
311B: FIRST BRUSH MEMBER
310R: BRISTLE
312: SECOND ROTATING BRUSHE
312A: SECOND BODY
312H: SECOND THROUGH-HOLE
311P,312P: PROTRUDING PORTION
312B: SECOND BRUSH MEMBER
313: COUPLER
313A: COUPLER BODY
313H: INSERTION GROOVE
313B: FIRST CATCHING PORTION
313C: SECOND CATCHING PORTION
313D: FIRST BENDING DEFORMATION PORTION
313E: SECOND BENDING DEFORMATION PORTION
314: SECOND SHAFT MEMBER
315: THIRD SHAFT MEMBER
320: RELEASE COVER
400: CONNECTOR
401: PASSAGE
410: INSERTION PORTION
420: FIRST CONNECTION PORTION
430: SECOND CONNECTION PORTION
431: RELEASE BUTTON
440: COUPLING PART
450: ELASTIC PIPE
451: ELASTIC TUBE
452: COIL SPRING

DETAILED DESCRIPTION

Advantages and features of the present disclosure and methods for achieving them will become apparent from the descriptions of aspects herein below with reference to the accompanying drawings. However, the present disclosure is not limited to the aspects disclosed herein but may be implemented in various different forms. The aspects are provided to make the description of the present disclosure thorough and to fully convey the scope of the present disclosure to those skilled in the art. It is to be noted that the scope of the present disclosure is defined only by the claims.

The shapes, sizes, ratios, angles, the number of elements given in the drawings are merely exemplary, and thus, the present disclosure is not limited to the illustrated details. Like reference numerals designate like elements throughout the specification.

Hereinafter, exemplary embodiments of the present disclosure will be described in detail with reference to the accompanying drawings. However, in the description of the present disclosure, a description of a function or configuration already publicly known will be omitted in order clarify the subject matter of the present disclosure.

FIG. 1 is a perspective view illustrating a vacuum cleaner 1 according to an embodiment of the present disclosure.

As illustrated in FIG. 1, the vacuum cleaner 1 according to the embodiment of the present disclosure includes a main body 20 and a suction nozzle 10.

The suction nozzle 10 is connected to the main body 20 through an extension pipe 30. The suction nozzle 10 may be connected directly to the main body 20. A user may hold a handle 21 formed on the main body 20 and move forward or rearward the suction nozzle 10 placed on a floor surface.

The main body 20 is configured to generate a difference in air pressure. An air blower is provided in the main body 20. When the air blower generates a difference in air pressure, dust and debris on the floor are moved to the main body 20 through an inlet 111 of the suction nozzle 10 and the extension pipe 30.

A centrifugal dust collector may be provided in the main body 20. The dust and debris may be received in a dust box 22.

Figure 2:
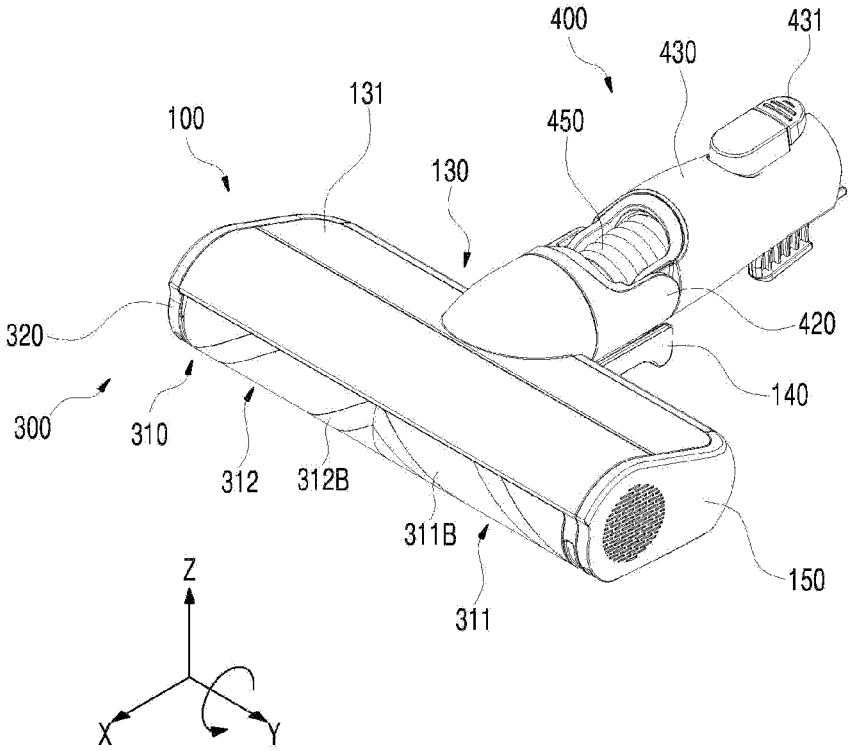
FIG. 2 is a perspective view illustrating a suction nozzle of the vacuum cleaner illustrated in FIG. 1 when viewed from above.
Figure 3:
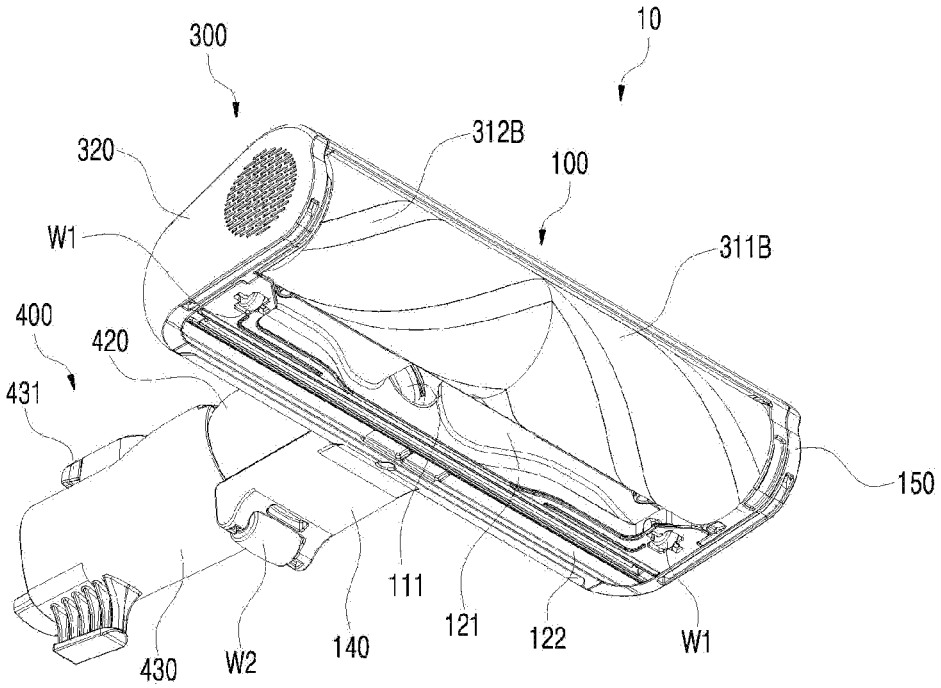
FIG. 3 is a perspective view illustrating the suction nozzle of the vacuum cleaner illustrated in FIG. 1 when viewed from below.
Figure 4:
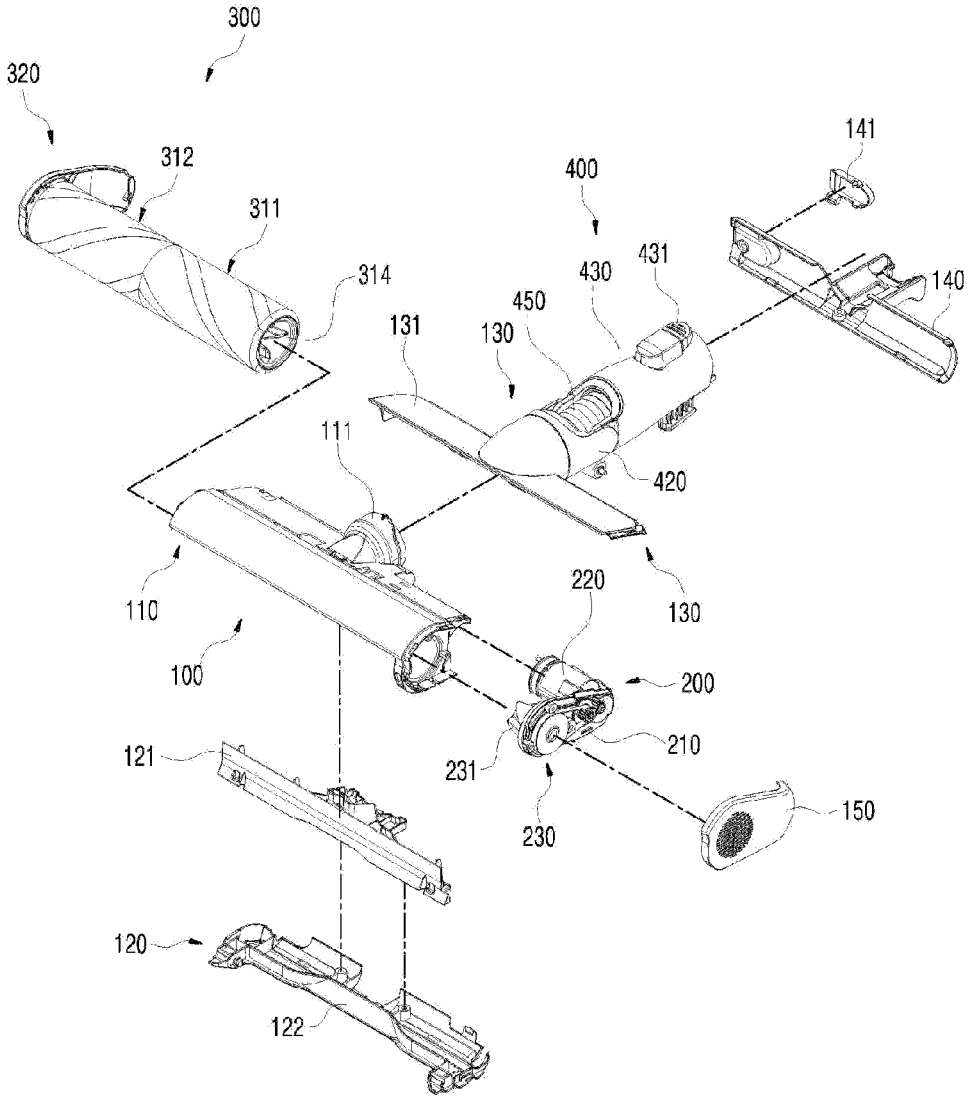
FIG. 4 is an exploded perspective view illustrating the suction nozzle illustrated in FIG. 2.

FIG. 2 is a perspective view illustrating the suction nozzle 10 of the vacuum cleaner 1 illustrated in FIG. 1 when viewed from above. FIG. 3 is a perspective view illustrating the suction nozzle 10 of the vacuum cleaner 1 illustrated in FIG. 1 when viewed from below. FIG. 4 is an exploded perspective view illustrating the suction nozzle 10 illustrated in FIG. 2.

The suction nozzle 10 is configured to suck dust on the floor by using the difference in air pressure. The suction nozzle 10 includes a housing 100, a driver 200, a brush module 300, and a connector 400.

The main technical feature of the present disclosure is a rotating brush 310 of the brush module 300. Therefore, the housing 100, the driver 200, and the connector 400 will be schematically described.

Hereinafter, for easy understanding of the present disclosure, a side of the suction nozzle 10 where the rotating brush 310 is positioned will be referred to as a front side of the suction nozzle 10, and a side of the suction nozzle 10 where the connector 400 is positioned will be referred to as a rear or back side of the suction nozzle 10.

FIGS. 1 to 3 illustrate a three-dimensional orthogonal coordinate system. A direction in which an X-axis of the three-dimensional orthogonal coordinate system is directed means the front or forward side. A direction in which a Y-axis of the three-dimensional orthogonal coordinate system is directed means a direction parallel to a rotation axis of the rotating brush. A direction in which a Z-axis of the three-dimensional orthogonal coordinate system means a top side.

The order in which the suction nozzle 10 is assembled is as follows. First, the connector 400 is assembled. Next, the connector 400 and a mounting housing 130 are assembled.

The mounting housing 130 is rotatably mounted on the connector 400. Then, the driver 200 is coupled to one side of a main housing 110.

Thereafter, the mounting housing 130 is coupled to an upper portion of the main housing 110. Next, a lower housing 120 is coupled to a lower portion of the main housing 110. Then, a support housing 140 is coupled to the lower portion of the main housing 110.

Next, a pressing button 141 is mounted on the support housing 140. Further, a side cover 150 is coupled to one side of the main housing 110.

Finally, a first shaft member 231 is fitted with a second shaft member 314 of the rotating brush 310, and a release cover 320 is detachably coupled to the other side of the main housing 110. Therefore, the process of assembling the suction nozzle 10 is completed.

Figure 5:
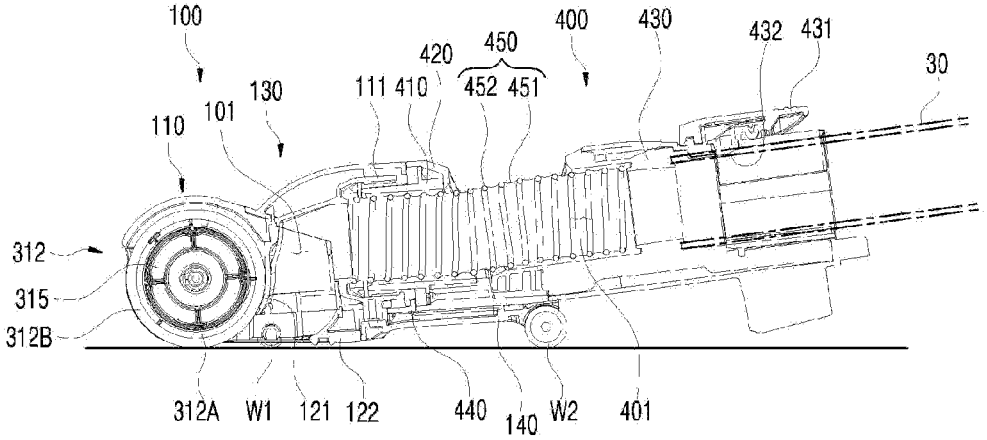
FIG. 5 is a cross-sectional view illustrating the suction nozzle illustrated in FIG. 2.

FIG. 5 is a cross-sectional view illustrating the suction nozzle 10 illustrated in FIG. 2.

As illustrated in FIGS. 4 and 5, the housing 100 is configured to guide dust and debris on the floor to a passage 401 of the connector 400.

The housing 100 includes the main housing 110, the lower housing 120, the mounting housing 130, and the support housing 140.

The main housing 110 defines the inlet 111 through which dust moves to the main body 20. The inlet 111 is formed at a rear side of the main housing 110. The inlet 111 has a cylindrical shape. The rotating brush 310 is mounted at a front side of the main housing 110.

The rotating brush 310 is rotated by the driver 200. The rotating brush 310 scrapes dust and debris on the floor surface and pushes the dust and debris rearward. The dust and debris pushed to the rear side of the rotating brush 310 may easily enter the inlet 111. The main housing 110 covers an upper side of the floor surface between the rotating brush 310 and the inlet 111.

The housing 100 defines a space (hereinafter, referred to as a 'suction space 101') between the rotating brush 310 and the inlet 111 and between the housing 100 and the floor surface. The suction space 101 is isolated from the outside except for a gap between the housing 100 and the floor surface. The dust and debris in the suction space 101 enters the passage 401 through the inlet 111.

As illustrated in FIGS. 4 and 5, the lower housing 120, together with the main housing 110, defines the suction space 101. The lower housing 120 includes a first lower housing 121 and a second lower housing 122.

The first and second lower housings 121 and 122 defines a wall surface between the rotating brush 310 and the inlet 111, and the wall surface guides the dust and debris in the suction space 101 toward the inlet 111.

A pair of first wheels W1 is mounted on the second lower housing 122.

The mounting housing 130 is rotatably coupled to the connector 400. A cover part 131 of the mounting housing 130 is mounted on the upper portion of the main housing 110.

The support housing 140 supports a lower portion of the suction nozzle 10 and a lower portion of the connector 400. A second wheel W2 is mounted on the support housing 140.

The second wheel W2 rolls on the floor surface while rotating together with the pair of first wheels W1.

The connector 400 enables the main body 20 and the suction nozzle 10 to rotate relative to each other. In addition, the connector 400 defines therein the passage 401 through which dust moves to the main body 20.

The connector 400 includes an insertion portion 410, a first connection portion 420, a second connection portion 430, a coupling part 440, and an elastic pipe 450.

When the cover part 131 is mounted on the upper portion of the main housing 110, the insertion portion 410 is inserted into the inlet 111.

The coupling part 440 connects the mounting housing 130 and the connector 400 so that the mounting housing 130 and the connector 400 are rotatable about the insertion portion 410.

The first and second connection portions 420 and 430 may each provided in the form of a pipe. The first and second connection portions 420 and 430 are rotatably coupled.

A release button 431 is disposed on an upper portion of the second connection portion 430. The release button 431 is connected to a catching portion 432. A movement of the extension pipe 30 is blocked by the catching portion 432.

As illustrated in FIG. 5, the elastic pipe 450 defines a passage 401 between the inlet 111 and the second connection portion 430. The elastic pipe 450 includes an elastic tube 451 and a coil spring 452.

The elastic tube 451 defines therein the passage 401. The elastic tube 451 has a cylindrical shape. The elastic tube 451 is made of soft resin.

Therefore, the elastic tube 451 is resiliently deformed when the first and second connection portions 420 and 430 rotate relative to each other and the mounting housing 130 and the first connection portion 420 rotate relative to each other.

The coil spring 452 is attached to an inner or outer surface of the elastic tube 451. The coil spring 452 maintains the cylindrical shape of the elastic tube 451.

As illustrated in FIGS. 4 and 5, the driver 200 is configured to rotate the rotating brush 310. The driver 200 is coupled to one side (hereinafter, referred to as 'left side') of the main housing 110.

The side cover 150 covers the driver 200. The side cover 150 is coupled to the left side of the housing 100 by means of a catching structure such as a hook. The side cover 150 has a hole through which air flows inward or outward.

The driver 200 includes a bracket 210, a motor 220, and a transmission 230.

The bracket 210 is coupled to the main housing 110 by bolting. The motor 220 is configured to generate a rotational force. The motor 220 may be provided as a brushless direct current (BLDC) motor. The motor 220 is coupled to the bracket 210.

The transmission 230 is configured to transmit a rotational motion of the motor 220 to the rotating brush 310. The transmission 230 is mounted on the bracket 210. The transmission 230 may be provided as a belt transmission device.

As illustrated in FIG. 4, the first shaft member 231 is configured to transmit a rotational motion of the belt transmission device to the rotating brush 310. The second shaft member 314 is provided at one side of the rotating brush 310 based on a direction of the rotation axis.

The first and second shaft members 231 and 314 define a plurality of surfaces that engage with one another. When the first and second shaft members 231 and 314 engage with each other, a rotation axis of the first shaft member 231 and the rotation axis of the second shaft member 314 are positioned on the same line.

The rotational force of the first shaft member 231 is transmitted to the second shaft member 314 through a contact surface. The rotation axis of the rotating brush 310 and the rotation axis of the first shaft member 231 are positioned on the same line in the state in which the first and second shaft members 231 and 314 engage with each other.

Figure 6:
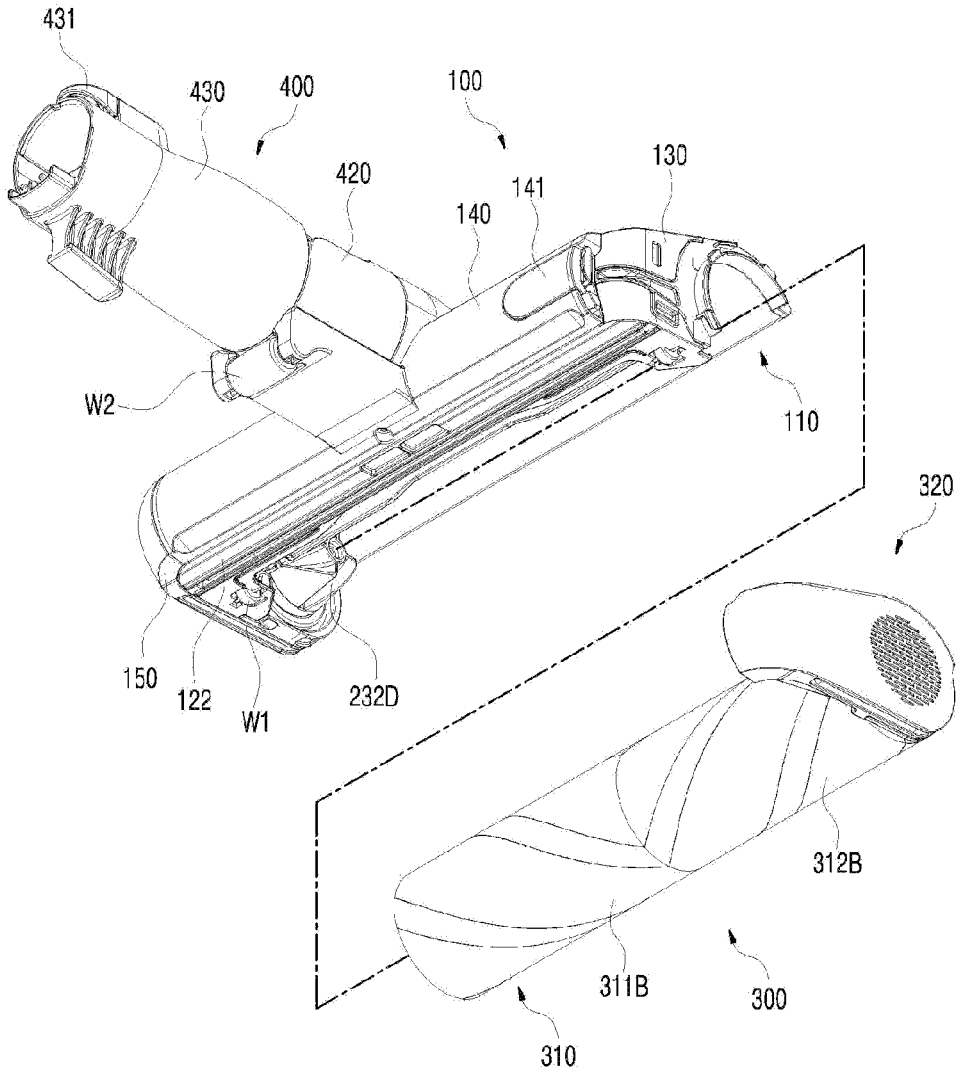
FIG. 6 is a perspective view illustrating a state in which a brush module is separated from the suction nozzle illustrated in FIG. 2.
Figure 7:
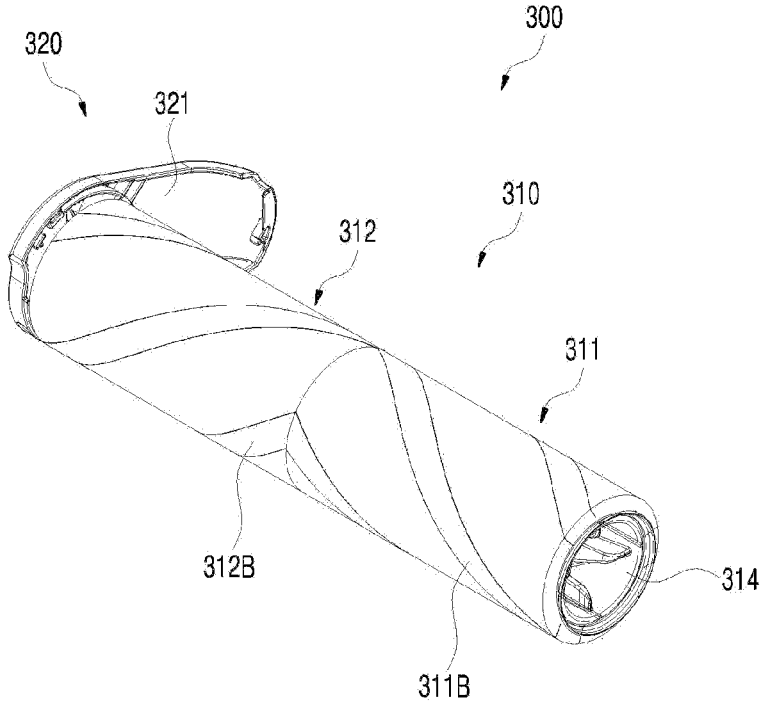
FIG. 7 is a perspective view illustrating the brush module illustrated in FIG. 6.
Figure 8:
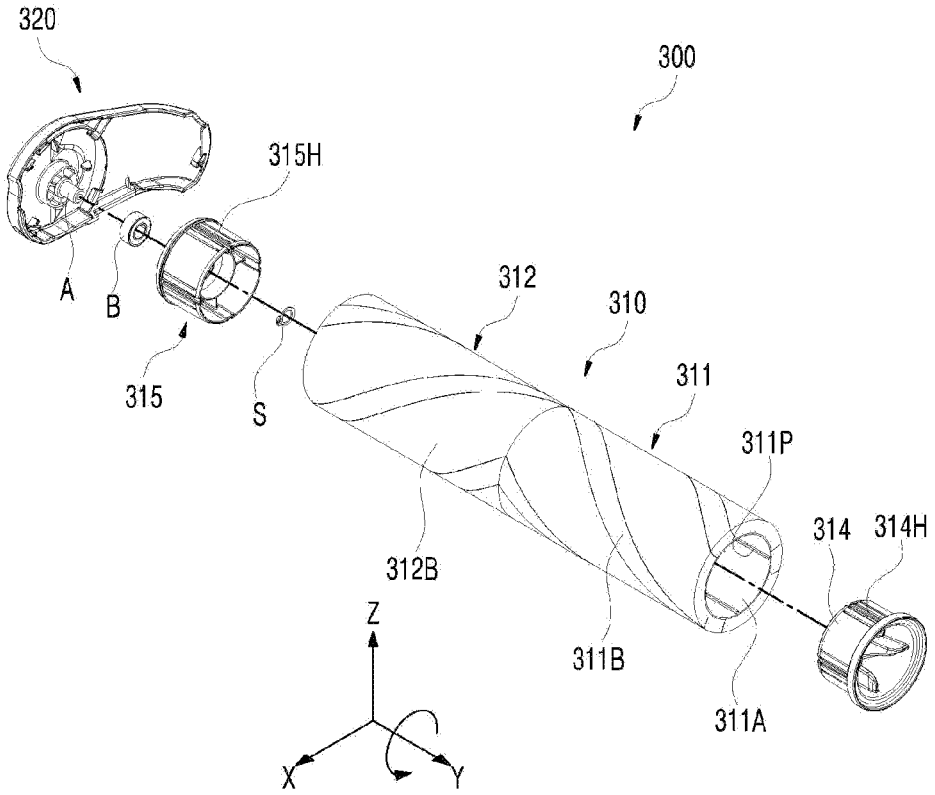
FIG. 8 is an exploded perspective view illustrating the brush module illustrated in FIG. 7.

FIG. 6 is a perspective view illustrating a state in which the brush module 300 is separated from the suction nozzle 10 illustrated in FIG. 2. FIG. 7 is a perspective view illustrating the brush module 300 illustrated in FIG. 6. FIG. 8 is an exploded perspective view illustrating the brush module 300 illustrated in FIG. 7.

As illustrated in FIGS. 6 and 7, the brush module 300 includes the rotating brush 310 and the release cover 320.

Figure 9:
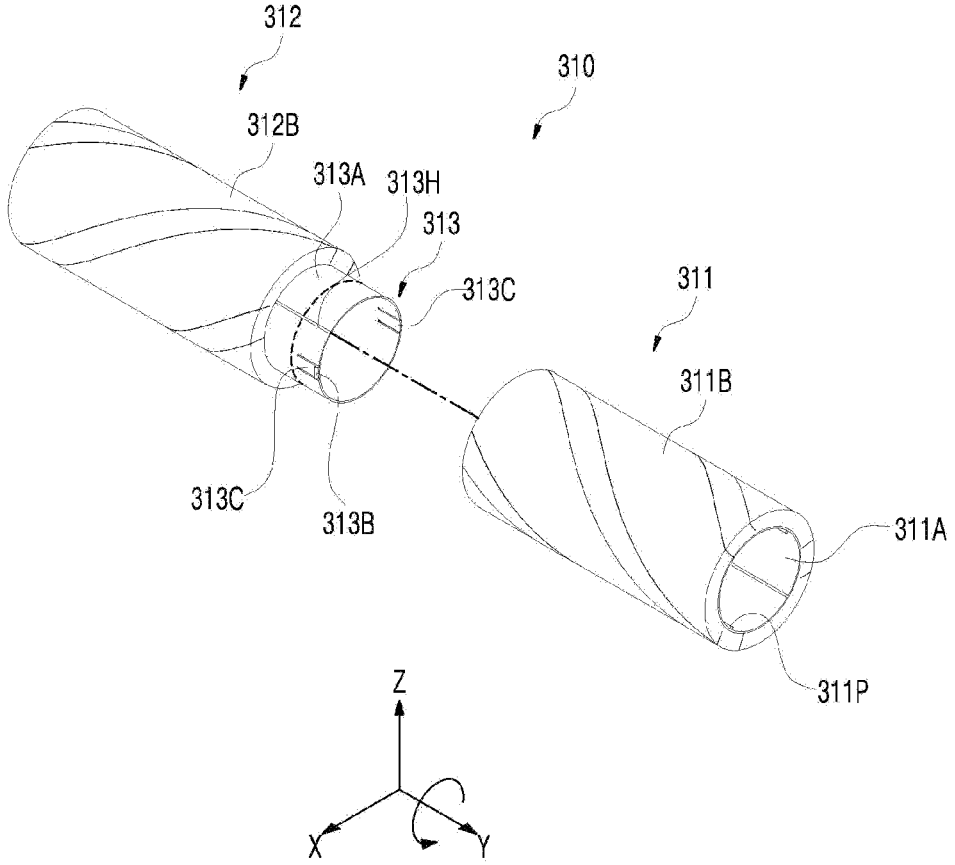
FIG. 9 is a perspective view illustrating a state in which first and second rotating brushes illustrated in FIG. 8 are separated.
Figure 10:
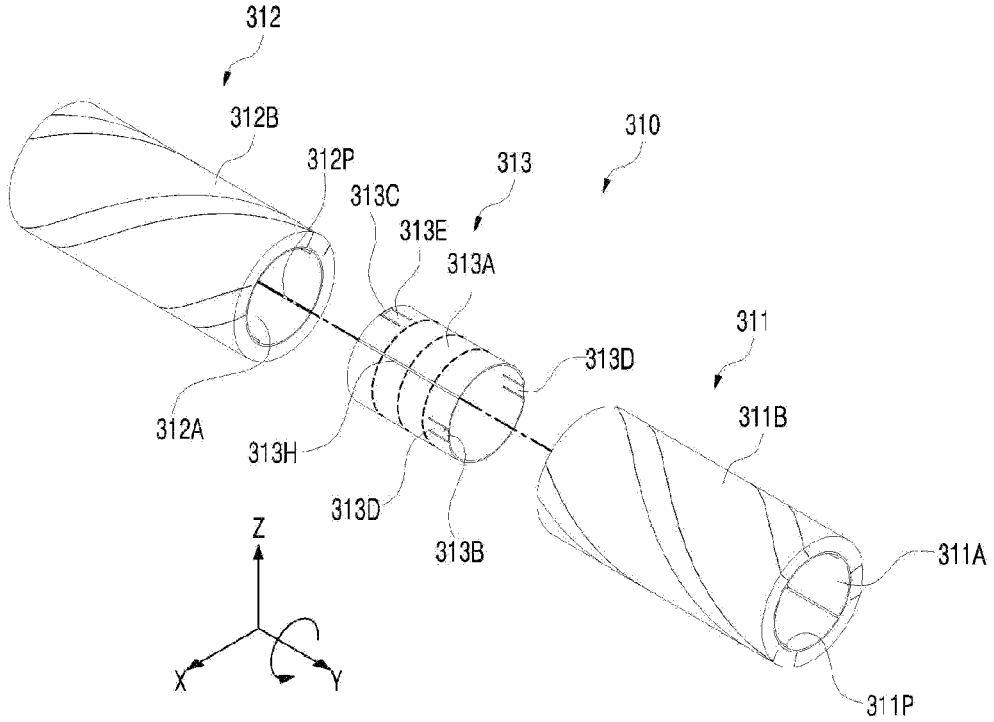
FIG. 10 is a perspective view illustrating a state in which the second rotating brush and a coupler, which are illustrated in FIG. 9, are separated.

FIG. 9 is a perspective view illustrating a state in which first and second rotating brushes 311 and 312 illustrated in FIG. 8 are separated. FIG. 10 is a perspective view illustrating a state in which the second rotating brush 312 and a coupler 313, which are illustrated in FIG. 9, are separated.

As illustrated in FIGS. 9 and 10, the rotating brush 310 scrapes dust and debris on the floor surface and pushes the dust and debris rearward. The rotating brush 310 includes the first rotating brush 311, the second rotating brush 312, and the coupler 313.

As illustrated in FIGS. 8 and 9, the first rotating brush 311 receives the rotational motion from the driver 200. The first rotating brush 311 includes a first body 311A, a first brush member 311B, and a second shaft member 314.

The first body 311A defines a framework of the first rotating brush 311. The first body 311A has a cylindrical shape having a vacant internal space. The first body 311A has a first through-hole 311H formed in a radial direction.

A central axis of the first body 311A acts as a central axis of the first rotating brush 311. The central axis of the first body 311A is parallel to the Y-axis direction. The first body 311A generates uniform rotational inertia in a circumferential direction thereof. The first body 311A may be made of aluminum.

The first brush member 311B is attached to an outer surface of the first body 311A. The first brush member 311B includes a plurality of bristles. The plurality of bristles scrapes dust and debris on the floor surface while the first body 311A rotates. The plurality of bristles may include fiber bristles and metal bristles.

The fiber bristles and the metal bristles may be attached directly to the outer surface of the first body 311A. Although not illustrated, a fiber layer may be attached to the outer surface of the first body 311A. The fiber bristles and the metal bristles may be attached to the fiber layer.

The fiber bristles may be made of synthetic resin such as nylon. The metal bristles may be made of a material containing an electrically conductive material. The metal bristle may be manufactured by coating a bristle made of synthetic resin with an electrically conductive material.

Static electricity generated by the fiber bristles may be discharged or eliminated to the floor surface through the metal bristles. Therefore, it is possible to inhibit the static electricity from being transmitted to the user.

The second shaft member 314 is configured to receive a rotational motion of the first shaft member 231. The second shaft member 314 is provided in one side opening of the first body 311A. The second shaft member 314 is inserted into one side opening of the first body 311A.

An insertion groove 314H is formed in the Y-axis direction in an outer surface of the second shaft member 314. A protruding portion 311P is formed in the Y-axis direction on an inner surface of the first body 311A. When the second shaft member 314 is inserted into the opening of the first body 311A, the protruding portion 311P is inserted into the insertion groove 314H. The protruding portion 311P prevents a relative rotation of the second shaft member 314.

The second shaft member 314 has a space into which the first shaft member 231 is inserted. When the rotating brush 310 moves in the Y-axis direction, the first shaft member 231 is inserted into the second shaft member 314.

The first and second shaft members 231 and 314 define a plurality of surfaces that engage with one another. When the first and second shaft members 231 and 314 engage with each other, the rotation axis of the first shaft member 231 and the rotation axis of the second shaft member 314 are positioned on the same line.

The rotational force of the first shaft member 231 is transmitted to the second shaft member 314 through the contact surface. The rotation axis of the rotating brush 310 and the rotation axis of the first shaft member 231 are positioned on the same line in the state in which the first and second shaft members 231 and 314 engage with each other.

As illustrated in FIGS. 8 and 9, the second rotating brush 312 is rotatably mounted in the housing 100 by means of the release cover 320. The release cover 320 and the housing 100 may be detachably coupled by means of a catching structure. Alternatively, the release cover 320 and the housing 100 may be coupled by bolting.

The second rotating brush 312 includes a second body 312A, a second brush member 312B, and a third shaft member 315.

The second body 312A defines a framework of the second rotating brush 312.

The second body 312A has a cylindrical shape having a vacant internal space. The second body 312A has a second through-hole 312H formed in a radial direction.

A central axis of the second body 312A acts as a central axis of the second rotating brush 312. The central axis of the second body 312A is parallel to the Y-axis direction. The second body 312A generates uniform rotational inertia in a circumferential direction thereof. The second body 312A may be made of aluminum.

The second brush member 312B is attached to an outer surface of the second body 312A. The second brush member 312B includes a plurality of bristles. The plurality of bristles scrapes dust and debris on the floor surface while the second body 312A rotates. The plurality of bristles may include fiber bristles and metal bristles.

The fiber bristles and the metal bristles may be attached directly to the outer surface of the second body 312A. Although not illustrated, a fiber layer may be attached to the outer surface of the second body 312A. The fiber bristles and the metal bristles may be attached to the fiber layer.

The fiber bristles may be made of synthetic resin such as nylon. The metal bristles may be made of a material containing an electrically conductive material. The metal bristle may be manufactured by coating a bristle made of synthetic resin with an electrically conductive material.

Static electricity generated by the fiber bristles may be discharged or eliminated to the floor surface through the metal bristles. Therefore, it is possible to inhibit the static electricity from being transmitted to the user.

The third shaft member 315 is configured to connect the second body 312A to the release cover 320 so that the second body 312A is rotatable. The third shaft member 315 is provided in one side opening of the second body 312A. The third shaft member 315 is inserted into one side opening of the second body 312A.

The insertion groove 313H is formed in the Y-axis direction in an outer surface of the third shaft member 315. A protruding portion 312P is formed in the Y-axis direction on an inner surface of the second body 312A. When the third shaft member 315 is inserted into the opening of the second body 312A, the protruding portion 312P is inserted into the insertion groove 313H. The protruding portion 312P prevents a relative rotation of the third shaft member 315.

A bearing B is mounted on the third shaft member 315. A fixing shaft A is provided on the release cover 320. The bearing B supports the fixing shaft A so that the fixing shaft A is rotatable. The fixing shaft A has a groove. A snap ring S is mounted in the groove to prevent the fixing shaft A and the third shaft member 315 from being separated from each other.

The coupler 313 couples the first and second rotating brushes 311 and 312. When the coupler 313 couples the first and second rotating brushes 311 and 312, the rotation axis of the first rotating brush 311 and the rotation axis of the second rotating brush 312 are positioned on the same line.

Figure 11:
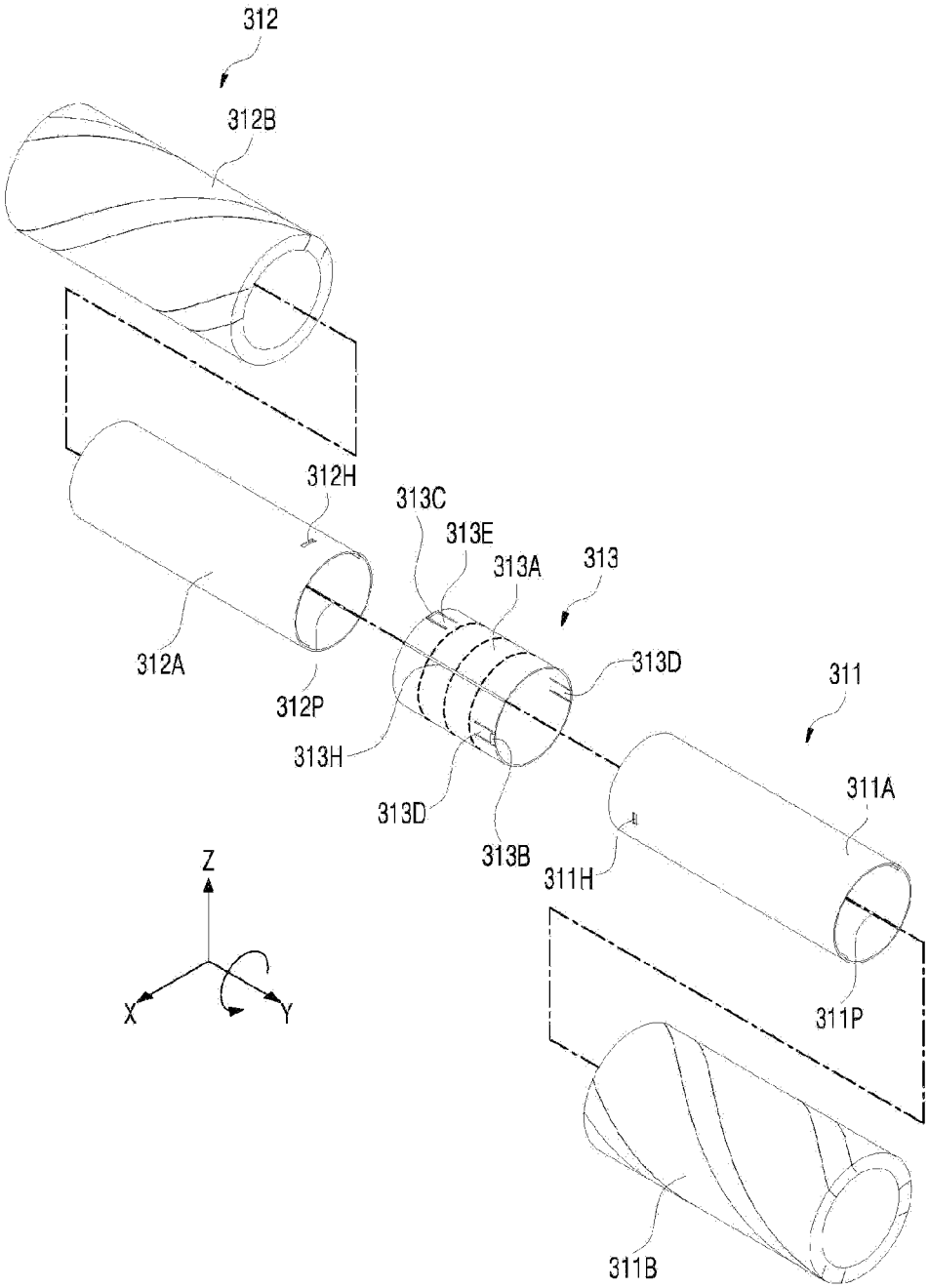
FIG. 11 is a perspective view illustrating a state in which a first body, a first brush member, a second body, and a second brush member, which are illustrated in FIG. 10, are separated.
Figure 12:
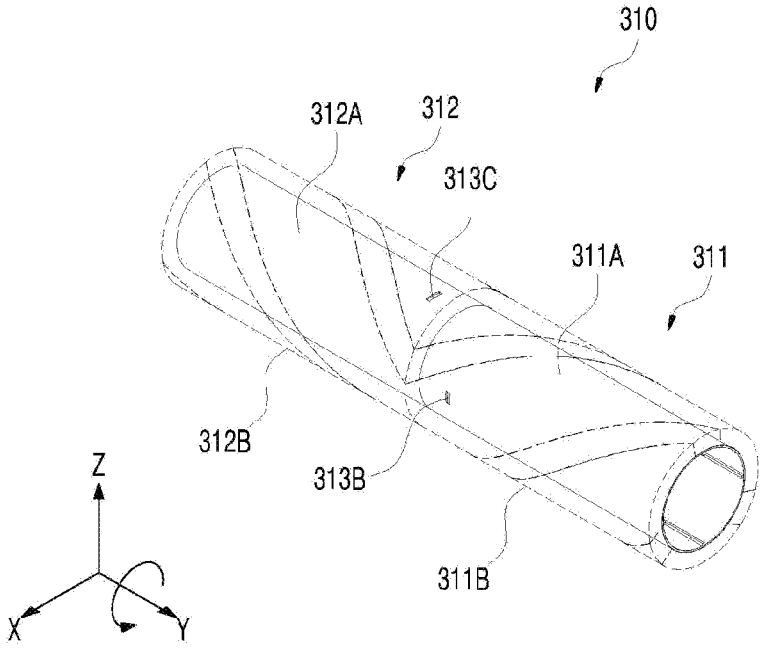
FIG. 12 is a transparent view illustrating the rotating brush illustrated in FIG. 8.

FIG. 11 is a perspective view illustrating a state in which the first body 311A, the first brush member 311B, the second body 312A, and the second brush member 312B, which are illustrated in FIG. 10, are separated. FIG. 12 is a transparent view illustrating the rotating brush 310 illustrated in FIG. 8.

As illustrated in FIGS. 11 and 12, the coupler 313 includes a coupler body 313A, a first catching portion 313B, a first bending deformation portion 313D, a second catching portion 313C, and a second bending deformation portion 313E.

An outer surface of the coupler body 313A is in contact with inner surfaces of the first and second bodies 311A and 312A in the circumferential direction. The coupler body 313A has a cylindrical shape having a vacant internal space. A central axis of the coupler body 313A is parallel to the central axis of the first body 311A and the central axis of the second body 312A. The coupler body 313A may be made of synthetic resin.

A Y-axis direction portion (hereinafter, referred to as a 'first body portion') of the coupler body 313A, based on a middle potion of the coupler body 313A, is in contact with the inner surface of the first body 311A in the circumferential direction. Further, a −Y-axis direction portion (hereinafter, referred to as a 'second body portion') of the coupler body 313A, based on the middle portion of the coupler body 313A, is in contact with the inner surface of the second body 312A in the circumferential direction.

The first catching portion 313B is configured to be inserted into the first through-hole 311H. The first catching portion 313B is formed on the first body portion. The first catching portion 313B protrudes in the radial direction from an outer surface of the first body portion.

The first bending deformation portion 313D is configured to connect the coupler body 313A and the first catching portion 313B. The first bending deformation portion 313D is formed on the first body portion. The first bending deformation portion 313D connects the coupler body 313A and the first catching portion 313B in the Y-axis direction.

An outer surface of the first bending deformation portion 313D has the same curvature as the outer surface of the coupler body 313A. Therefore, when the first catching portion 313B is inserted into the first through-hole 311H, the outer surface of the first bending deformation portion 313D comes into contact with the inner surface of the first body 311A in the circumferential direction.

As described above, the protruding portion 311A is formed in the Y-axis direction on the inner surface of the first body 311A. The insertion groove 313H is formed in the Y-axis direction in the outer surface of the coupler body 313A.

When the first body portion is inserted into a-Y-axis direction opening of the first body 311A, the protruding portion 311A is inserted into the insertion groove 313H. The protruding portion 311A moves along the insertion groove 313H until the first catching portion 313B is inserted into the first through-hole 311H.

That is, the protruding portion 311A and the insertion groove 313H guide the first catching portion 313B to the first through-hole 311H. In addition, the protruding portion 311A and the insertion groove 313H prevent a relative rotation between the coupler body 313A and the first body 311A.

When the first body portion is inserted into a-Y-axis direction opening of the first body 311A, the first catching portion 313B is caught by a periphery of the opening of the first body portion. An assembler inserts the first body portion into the −Y-axis direction opening of the first body 311A while pressing the first catching portion 313B in the direction of the central axis of the coupler body 313A.

A state in which the first bending deformation portion 313D is bent and deformed in the direction of the central axis of the coupler body 313A is maintained until the first catching portion 313B is inserted into the first through-hole 311H.

When the first catching portion 313B is inserted into the first through-hole 311H as the first bending deformation portion 313D is elastically restored, the outer surface of the first bending deformation portion 313D comes into contact with the inner surface of the coupler body 313A in the circumferential direction.

When the first catching portion 313B is inserted into the first through-hole 311H, the relative movement and rotation between the coupler body 313A and the first body 311A are prevented.

A bonding agent is applied onto a predetermined Y-axis direction region and a predetermined-Y-axis direction region on the outer surface of the coupler body 313A based on the middle portion of the coupler body 313A. The dotted lines illustrated on the outer surface of the coupler body 313A mean the regions on which the bonding agent is applied, based on the middle portion of the coupler body 313A.

When the first body portion is inserted into the −Y-axis direction opening of the first body 311A, a bonding layer is interposed between the inner surface of the first body 311A and the outer surface of the coupler body 313A. The bonding layer improves a coupling force between the first body 311A and the coupler body 313A.

The second catching portion 313C is configured to be inserted into the second through-hole 312H. The second catching portion 313C is formed on the second body portion. The second catching portion 313C protrudes in the radial direction from an outer surface of the second body portion.

The second bending deformation portion 313E is configured to connect the coupler body 313A and the second catching portion 313C. The second bending deformation portion 313E is formed on the second body portion. The second bending deformation portion 313E connects the coupler body 313A and the second catching portion 313C in the −Y-axis direction.

An outer surface of the second bending deformation portion 313E has the same curvature as the outer surface of the coupler body 313A. Therefore, when the second catching portion 313C is inserted into the second through-hole 312H, the outer surface of the second bending deformation portion 313E comes into contact with the inner surface of the second body 312A in the circumferential direction.

As described above, the protruding portion 312P is formed in the Y-axis direction on the inner surface of the second body 312A. The insertion groove 313H is formed in the Y-axis direction in the outer surface of the coupler body 313A.

When the second body portion is inserted into the Y-axis direction opening of the second body 312A, the protruding portion 312P is inserted into the insertion groove 313H. The protruding portion 312P moves along the insertion groove 313H until the second catching portion 313C is inserted into the second through-hole 312H.

That is, the protruding portion 312P and the insertion groove 313H guide the second catching portion 313C to the second through-hole 312H. In addition, the protruding portion 312P and the insertion groove 313H prevent a relative rotation between the coupler body 313A and the second body 312A.

When the second body portion is inserted into the Y-axis direction opening of the second body 312A, the second catching portion 313C is caught by a periphery of the opening of the second body portion. The assembler inserts the second body portion into the Y-axis direction opening of the second body 312A while pressing the second catching portion 313C in the direction of the central axis of the coupler body 313A.

A state in which the second bending deformation portion 313E is bent and deformed in the direction of the central axis of the coupler body 313A is maintained until the second catching portion 313C is inserted into the second through-hole 312H.

When the second catching portion 313C is inserted into the second through-hole 312H as the second bending deformation portion 313E is elastically restored, the outer surface of the second bending deformation portion 313E comes into contact with the inner surface of the coupler body 313A in the circumferential direction.

When the second catching portion 313C is inserted into the second through-hole 312H, the relative movement and rotation between the coupler body 313A and the second body 312A are prevented. When the second catching portion 313C is inserted into the second through-hole 312H, the first and second bodies 311A and 312A come into contact with each other in a direction of the rotation axis of the brush member, thereby defining a contact surface (hereinafter, referred to as a 'reference surface').

A bonding agent is applied onto a predetermined Y-axis direction region and a predetermined-Y-axis direction region on the outer surface of the coupler body 313A based on the middle portion of the coupler body 313A. When the second body portion is inserted into the Y-axis direction opening of the second body 312A, a bonding layer is interposed between the inner surface of the second body 312A and the outer surface of the coupler body 313A. The bonding layer improves a coupling force between the second body 312A and the coupler body 313A.

Figure 13:
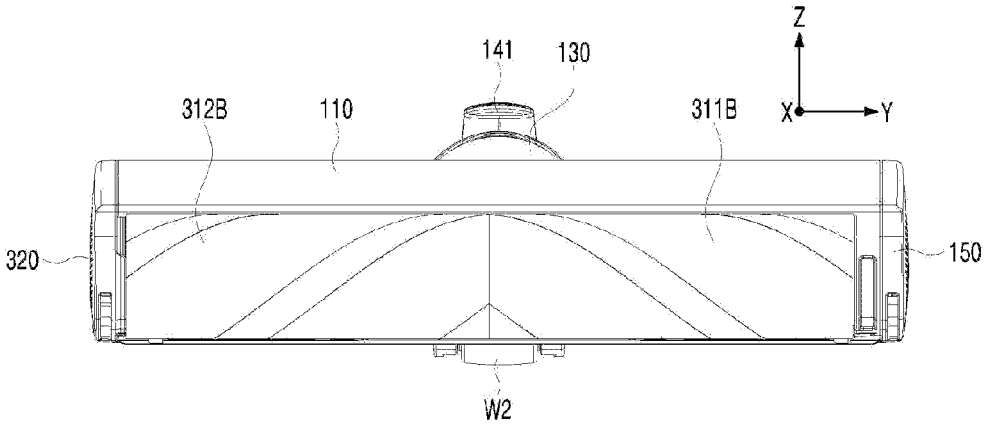
FIG. 13 is a front view illustrating the suction nozzle illustrated in FIG. 2.
Figure 18:
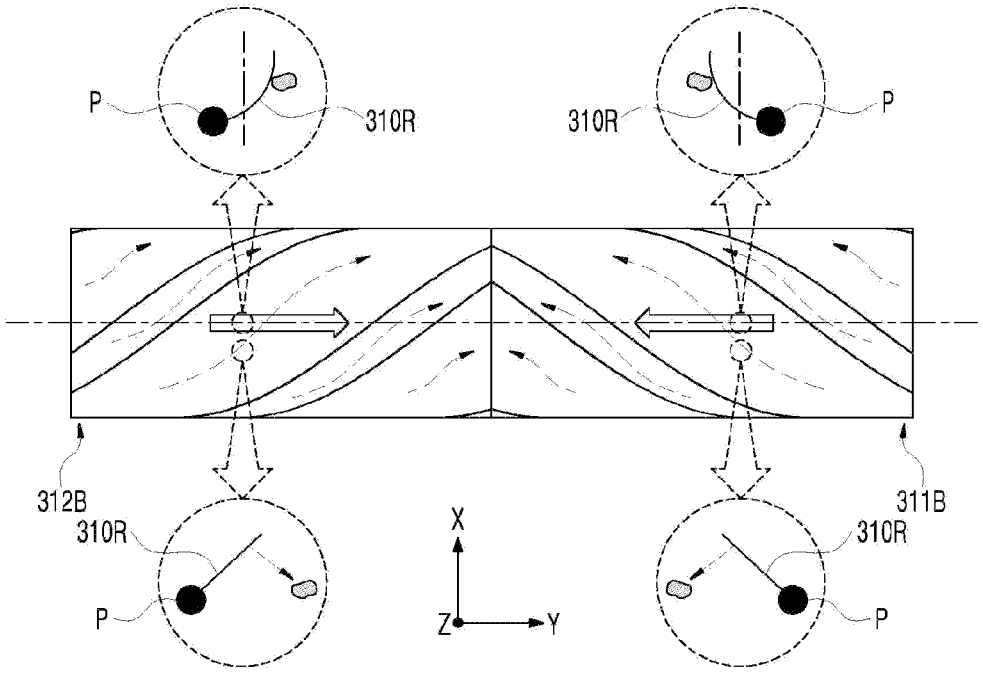
FIG. 18 is a bottom plan view illustrating the rotating brush of the suction nozzle illustrated in FIG. 2.

FIG. 13 is a front view illustrating the suction nozzle 10 illustrated in FIG. 2. FIG. 18 is a bottom plan view illustrating the rotating brush 310 of the suction nozzle 10 illustrated in FIG. 2. The dotted lines in FIG. 18 mean texture directions of the bristles. The bristles are formed to lie in the directions indicated by the dotted arrow lines.

The suction nozzle 10 sucks debris such as hairs and dust on the floor while moving forward or rearward. In this case, the rotating brush 310 pushes the debris such as hairs and dust on the floor rearward, i.e., toward the inlet while rotating.

Figure 14:
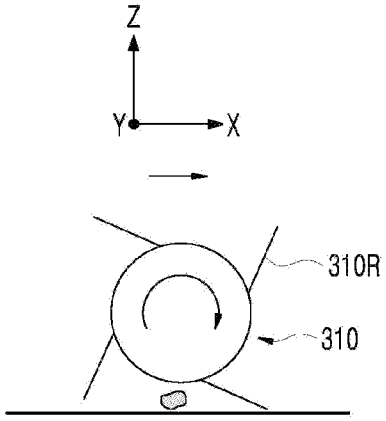
FIG. 14 is a schematic view illustrating a state in which the suction nozzle illustrated in FIG. 2 is used.
Figure 15:
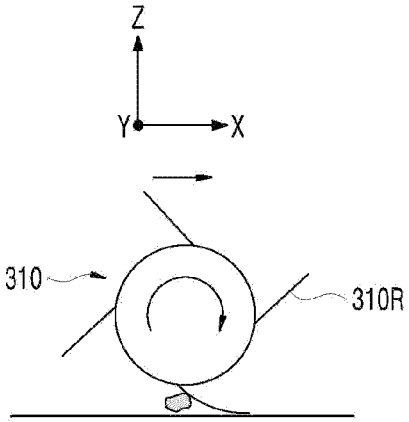
FIG. 15 is a schematic view illustrating a state in which bristles of the rotating brush illustrated in FIG. 14 are bent and deformed by a floor.

FIG. 14 is a schematic view illustrating a state in which the suction nozzle 10 illustrated in FIG. 2 is used. FIG. 15 is a schematic view illustrating a state in which bristles 310R of the rotating brush 310 illustrated in FIG. 14 are bent and deformed by the contact with the floor.

As illustrated in FIG. 14, the bristles 310R of the rotating brush 310 form textures inclined in the direction opposite to the rotation direction of the rotating brush 310. As illustrated in FIG. 15, the bristles 310R of the rotating brush 310 are bent and deformed by being brought into contact with the floor and further inclined in the direction opposite to the rotation direction of the rotating brush 310.

Figure 16:
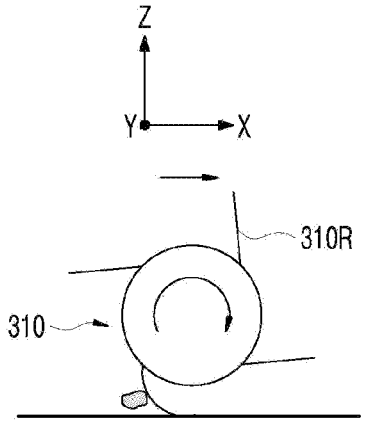
FIG. 16 is a schematic view illustrating a state in which the bristles of the rotating brush illustrated in FIG. 15 push debris on the floor rearward.
Figure 17:
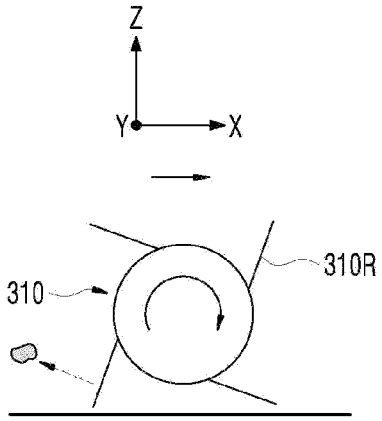
FIG. 17 is a schematic view illustrating a state in which debris on the floor illustrated in FIG. 16 is moved rearward by the bristles of the rotating brush.

FIG. 16 is a schematic view illustrating a state in which the bristles 310R of the rotating brush 310 illustrated in FIG. 15 push debris on the floor rearward. FIG. 17 is a schematic view illustrating a state in which debris on the floor illustrated in FIG. 16 is moved rearward by the bristles 310R of the rotating brush 310.

As illustrated in FIG. 16, the bristles 310R of the rotating brush 310 push debris such as hairs and dust on the floor rearward in the state in which the bristles 310R are bent and deformed. As illustrated in FIG. 17, when the bristles 310R of the rotating brush 310 are moved away from the floor, the bristles 310R return to an original state while being elastically restored.

In this case, the debris, which is in contact with the bristles 310R, is pushed to the rear side of the rotating brush 310 by kinetic energy and elastic restoring force of the bristles 310R. That is, the bristles 310R of the first and second rotating brushes 311 and 312 push dust toward the inlet while being elastically bent and deformed by the floor.

FIG. 18 should be understood as a view illustrating the rotating brush 310, which generates friction with an upper surface of the floor, when viewed from below the transparent floor. P in FIG. 18 means a point at which the bristles 310R are implanted.

As illustrated in FIG. 18, the textures of the bristles 310R of the first and second rotating brushes 311 and 312 are spirally formed around the rotation axis of the rotating brush 310. In addition, the textures of the bristles 310R of the first and second rotating brushes 311 and 312 are symmetrically formed with respect to the reference surface.

Further, the bristles 310R of the first and second rotating brushes 311 and 312 form the textures inclined toward the reference surface. In addition, the bristles 310R of the first and second rotating brushes 311 and 312 form the textures inclined in the direction opposite to the rotation direction of the rotating brush 310.

As illustrated in enlarged views at the top side of FIG. 18, the bristles 310R of the first and second rotating brushes 311 and 312, which are in contact with the floor, are bent and deformed in the X-axis direction, i.e., the direction opposite to the movement direction by a frictional force with the floor.

As illustrated in the enlarged views at the bottom side of FIG. 18, the bristles 310R of the first and second rotating brushes 311 and 312 are elastically restored and returned to the original state while moving away from the floor. In this case, the debris, which is in contact with the bristles 310R, is pushed toward the reference surface in the −X-axis direction by the kinetic energy and elastic restoring force of the bristles 310R.

That is, the bristles 310R of the first and second rotating brushes 311 and 312 push dust toward the inlet while being elastically bent and deformed by the floor. In addition, the debris such as hairs and dust attached to the first and second rotating brushes 311 and 312 is moved to the reference surface. The user may easily remove the debris such as hairs and dust attached to the middle portion of the rotating brush 310.

While the foregoing has been given by way of illustrative example of the present disclosure, all such and other modifications and variations thereto as would be apparent to those skilled in the art are deemed to fall within the broad scope and ambit of this disclosure as is herein set forth. Accordingly, such modifications or variations are not to be regarded as a departure from the spirit or scope of the present disclosure, and it is intended that the present disclosure cover the modifications and variations of this disclosure provided they come within the scope of the appended claims and their equivalents.

What is claimed is:

1. A vacuum cleaner comprising:

a suction nozzle configured to suction dust on a floor; and a main body configured to receive the dust, wherein the suction nozzle comprises:

a housing that defines an inlet configured to provide the dust to the main body, a rotating brush rotatably disposed in the housing and configured to rotate about a rotation axis to thereby cause the dust on the floor to move toward the inlet, and a driver disposed at the housing and configured to rotate the rotating brush, wherein the rotating brush comprises:

a first rotating brush configured to receive rotational force from the driver, a second rotating brush coupled to the first rotating brush, and a coupler that couples the first rotating brush and the second rotating brush such that the first rotating brush and the second rotating brush are arranged along the rotation axis, the coupler being configured to receive the rotational force from the first rotating brush and transmit the rotational force received from the first rotating brush to the second rotating brush, wherein the first rotating brush and the second rotating brush accommodate the coupler and surround an outer circumferential surface of the coupler, wherein the coupler has (i) a first end disposed inside the first rotating brush and (ii) a second end disposed inside the second rotating brush and spaced apart from the first end in a direction of the rotation axis, and wherein a length of the coupler between the first and second ends of the coupler in the direction of the rotation axis is less than a combined length of the first rotating brush and the second rotating brush in the direction of the rotation axis.

2. The vacuum cleaner of claim 1, wherein the first rotating brush comprises:

a first brush body that has a cylindrical shape, the first brush body having a first through-hole defined through an outer circumferential surface of the first brush body; and a first brush member attached to the outer circumferential surface of the first brush body, wherein the second rotating brush comprises:

a second brush body that has a cylindrical shape and is in contact with the first brush body, the second brush body having a second through-hole defined through an outer circumferential surface of the second brush body, and a second brush member attached to the outer circumferential surface of the second brush body, and wherein the coupler comprises:

a coupler body having an outer circumferential surface that is in contact with an inner circumferential surface of each of the first and second brush bodies, a plurality of catching portions that are inserted into the first and second through-holes, respectively, and a plurality of bending deformation portions that connect the coupler body to each of the plurality of catching portions, each of the plurality of bending deformation portions being configured to bend in a radial direction of the coupler body.

3. The vacuum cleaner of claim 2, wherein the first rotating brush further comprises a first protruding portion that protrudes from the inner circumferential surface of the first brush body and extends along the rotation axis, wherein the second rotating brush further comprises a second protruding portion that protrudes from the inner circumferential surface of the second brush body and extends along the rotation axis, and wherein the coupler body has an insertion groove that is defined at the outer circumferential surface of the coupler body and extends along the rotation axis, the insertion groove being configured to guide each of the first protruding portion and the second protruding portion such that the plurality of catching portions are inserted into the first through-hole and the second through-hole, respectively.

4. The vacuum cleaner of claim 2, wherein the rotating brush further comprises a bonding layer disposed between the outer circumferential surface of the coupler body and the inner circumferential surface of each of the first and second brush bodies.

5. The vacuum cleaner of claim 1, wherein the first rotating brush comprises:

a first brush body that has a cylindrical shape, the first brush body having a first through-hole defined through the first brush body in a radial direction; and a first brush member attached to an outer circumferential surface of the first brush body, and wherein the coupler comprises:

a coupler body having an outer circumferential surface that is in contact with an inner circumferential surface of the first brush body, a first catching portion inserted into the first through-hole, and a first bending deformation portion that connects the coupler body to the first catching portion and is configured to bend in the radial direction.

6. The vacuum cleaner of claim 5, wherein the second rotating brush comprises:

a second brush body that has a cylindrical shape, the second brush body having a second through-hole defined through the second brush body in the radial direction; and a second brush member attached to an outer circumferential surface of the second brush body, wherein the outer circumferential surface of the coupler body is in contact with an inner circumferential surface of the second brush body, and wherein the coupler further comprises:

a second catching portion inserted into the second through-hole, and a second bending deformation portion that connects the coupler body to the second catching portion and is configured to bend in the radial direction.

7. The vacuum cleaner of claim 1, wherein the first rotating brush comprises:

a first brush body that defines a first contact surface in contact with the second rotating brush in a direction parallel to the rotation axis; and a first brush member attached to an outer circumferential surface of the first brush body, wherein the second rotating brush comprises:

a second brush body that defines a second contact surface in contact with the first contact surface in the direction parallel to the rotation axis, and a second brush member attached to an outer circumferential surface of the second brush body, wherein each of the first brush member and the second brush member comprises a plurality of bristles that are configured to elastically bend based on contacting the floor to thereby move the dust toward the inlet, and wherein the plurality of bristles are spirally arranged about the rotation axis on each of the first brush body and the second brush body, the plurality of bristles defining a texture pattern that is symmetrical with respect to a reference plane defined by one of the first contact surface or the second contact surface.

8. The vacuum cleaner of claim 7, wherein the texture pattern is inclined with respect to the rotation axis and extends toward the reference plane.

9. The vacuum cleaner of claim 7, wherein the texture pattern comprises:

a first spiral pattern defined by the plurality of bristles arranged on the first brush body, the first spiral pattern being arranged about the rotation axis in a first direction; and a second spiral pattern defined by the plurality of bristles arranged on the second brush body, the second spiral pattern being arranged about the rotation axis in a second direction opposite to the first direction.

10. The vacuum cleaner of claim 9, wherein the first spiral pattern extends to the first contact surface, and the second spiral pattern extends to the second contact surface such that the first spiral pattern and the second spiral pattern are connected to each other.

11. The vacuum cleaner of claim 1, wherein the driver comprises a motor coupled to the housing and configured to generate the rotational force, the motor comprising a motor shaft that extends parallel to the rotational axis of the rotating brush.

12. A vacuum cleaner comprising: a suction nozzle configured to suction dust on a floor; and a main body configured to receive the dust, wherein the suction nozzle comprises:

a housing that defines an inlet configured to provide the dust to the main body, a rotating brush configured to rotate about a rotation axis to thereby cause the dust on the floor to move toward the inlet, and a driver disposed at the housing and configured to rotate the rotating brush, wherein the rotating brush comprises:

a first rotating brush that extends along the rotation axis and is configured to receive rotational force from the driver, a second rotating brush that extends along the rotation axis and is coupled to and in contact with the first rotating brush, and a coupler that coaxially couples the first rotating brush and the second rotating brush along the rotation axis, the coupler being configured to receive the rotational force from the first rotating brush and transmit the rotational force received from the first rotating brush to the second rotating brush, wherein the first rotating brush and the second rotating brush accommodate the coupler and surround an outer circumferential surface of the coupler, wherein each of the first rotating brush and the second rotating brush comprises a plurality of bristles that are configured to elastically bend based on contacting the floor to thereby move the dust toward the inlet, wherein the plurality of bristles are spirally arranged about the rotation axis on each of the first rotating brush and the second rotating brush, the plurality of bristles defining a texture pattern that is symmetrical with respect to a contact surface between the first rotating brush and the second rotating brush, wherein the coupler has (i) a first end disposed inside the first rotating brush and (ii) a second end disposed inside the second rotating brush and spaced apart from the first end in a direction of the rotation axis, and wherein a length of the coupler between the first and second ends of the coupler in the direction of the rotation axis is less than a combined length of the first rotating brush and the second rotating brush in the direction of the rotation axis.

13. The vacuum cleaner of claim 12, wherein the texture pattern of the plurality of bristles comprises:

a first spiral pattern defined by the plurality of bristles arranged on the first rotating brush, the first spiral pattern being arranged about the rotation axis in a first direction; and a second spiral pattern defined by the plurality of bristles arranged on the second rotating brush, the second spiral pattern being arranged about the rotation axis in a second direction opposite to the first direction.

14. The vacuum cleaner of claim 13, wherein the first spiral pattern and the second spiral pattern extend toward each other and are connected to each other at the contact surface.

15. The vacuum cleaner of claim 12, wherein the first rotating brush further comprises a first brush body that has a cylindrical shape and supports the plurality of bristles, the first brush body having a first through-hole defined through an outer circumferential surface of the first brush body, wherein the second rotating brush further comprises a second brush body that has a cylindrical shape and is in contact with the first brush body, the second brush body supporting the plurality of bristles and having a second through-hole defined through an outer circumferential surface of the second brush body.

16. The vacuum cleaner of claim 15, wherein the coupler comprises:

a coupler body having an outer circumferential surface that is in contact with an inner circumferential surface of each of the first and second brush bodies; and a plurality of catching portions that are inserted into the first and second through-holes, respectively, based on the first rotating brush and the second rotating brush being coupled to the coupler body, each of the plurality of catching portions being configured to move in a radial direction of the coupler body.

17. The vacuum cleaner of claim 16, wherein the first rotating brush further comprises a first protruding portion that protrudes from the inner circumferential surface of the first brush body and extends along the rotation axis, wherein the second rotating brush further comprises a second protruding portion that protrudes from the inner circumferential surface of the second brush body and extends along the rotation axis, and wherein the coupler body has an insertion groove that is defined at the outer circumferential surface of the coupler body and extends along the rotation axis, the insertion groove being configured to guide each of the first protruding portion and the second protruding portion such that the plurality of catching portions are inserted into the first through-hole and the second through-hole, respectively.

18. The vacuum cleaner of claim 12, wherein the driver comprises a motor coupled to the housing and configured to generate the rotational force, the motor comprising a motor shaft that extends parallel to the rotational axis of the rotating brush.

19. The vacuum cleaner of claim 1, wherein the outer circumferential surface of the coupler is in contact with inner circumferential surfaces of the first rotating brush and the second rotating brush.

* * * * *